US007180246B2

(12) United States Patent
Nakamura et al.

(10) Patent No.: US 7,180,246 B2
(45) Date of Patent: Feb. 20, 2007

(54) DISPLAY DEVICE

(75) Inventors: Tomoki Nakamura, Chiba (JP); Yoshiyuki Kaneko, Hachioji (JP); Toshifumi Ozaki, Mobara (JP)

(73) Assignee: Hitachi Displays, Ltd., Chiba-ken (JP)

( * ) Notice: Subject to any disclaimer, the term of this patent is extended or adjusted under 35 U.S.C. 154(b) by 0 days.

(21) Appl. No.: 10/931,120

(22) Filed: Sep. 1, 2004

(65) Prior Publication Data

US 2005/0062694 A1 Mar. 24, 2005

(30) Foreign Application Priority Data

Sep. 10, 2003 (JP) ..... 2003-317718

(51) Int. Cl.
*G09G 3/10* (2006.01)

(52) U.S. Cl. ..... 315/169.3; 313/309; 345/80

(58) Field of Classification Search ..... 315/169.1, 315/169.3; 313/309, 310, 336, 351, 495; 345/80, 307; 445/6, 24
See application file for complete search history.

(56) References Cited

U.S. PATENT DOCUMENTS 5,760,535 A 6/1998 Moyer et al. ..... 313/309
6,281,621 B1 * 8/2001 Nakamoto et al. ..... 313/309
6,373,174 B1 * 4/2002 Talin et al. ..... 313/309
6,632,116 B2 * 10/2003 Watanabe et al. ..... 445/24
6,707,437 B1 3/2004 Kuno et al. ..... 345/74.1
6,936,972 B2 * 8/2005 Takeuchi et al. ..... 315/169.3

FOREIGN PATENT DOCUMENTS

JP 10-134701 10/1997
JP 2000-306508 4/1999

* cited by examiner

*Primary Examiner*—Tuyet Vo
*Assistant Examiner*—Jimmy Vu
(74) *Attorney, Agent, or Firm*—Reed Smith LLP; Stanley P. Fisher, Esq.; Juan Carlos A. Marquez, Esq.

(57) ABSTRACT

To detect a dark current when an abnormal discharge occurs between an anode and respective electrodes, on an inner surface of a front substrate, a dark current detection electrode is formed in a state that the dark current detection electrode is positioned adjacent to the outside of a screen display region on which an anode is formed and on a plane substantially equal to a plane on which the anode is formed. Then, between an electrode terminal of the dark current detection electrode and a ground, an ammeter which detects the flow of a dark current and a DC power source having a preset voltage value which is more or less lower than a high voltage supplied to the anode are connected in series.

10 Claims, 4 Drawing Sheets

DISPLAY DEVICE

BACKGROUND OF THE INVENTION

The present invention relates to an image display device which utilizes emission of electrons into vacuum, and more particularly to dark current detection means which detects a dark current which flows at the time of occurrence of an abnormal discharge which takes place between an anode electrode and other electrode (control electrode, cathode or the like).

As an image display device which exhibits high brightness and high definition, conventionally, a color cathode ray tube has been popularly used. However, along with the recent demand for achieving high image quality in information processing equipment and television broadcasting, a further demand for a planar display (panel display) which is lightweight and space-saving while having favorable characteristics such as high brightness and high definition is increasing.

As a representative example, a liquid crystal display device, a plasma display device and the like have been commercially available. Further, with respect to the image display device which aims at high brightness particularly, various types of panel-type display devices such as a display device which makes use of emission of electron in vacuum from electron sources (hereinafter referred to as an electron emission type display device or an electric field emission type display device, hereinafter abbreviated as FED) and an organic EL display device which features low power consumption.

FIG. 6 is an enlarged cross-sectional view of the vicinity of one pixel for schematically explaining the basic structure of the FED. In FIG. 6, the FED includes a back substrate SUB1 which forms cathode lines CL which include cathodes K as electric field-emission-type electron sources and a control electrode G1 on an inner surface thereof and a front substrate SUB2 which forms an anode ADE, phosphors PHS and a black matrix BM respectively on an inner surface thereof which faces the back substrate SUB1 in an opposed manner, wherein the FED is constituted by laminating both substrates SUB1, SUB2 by inserting a sealing frame between inner peripheries of both substrates SUB1, SUB2 and by creating a vacuum in the inside of the laminated structure.

Further, there has been also known the structure which provides insulating space holding members ISP between the back substrate SUB1 and the front substrate SUB2 to hold a distance of given size between the back substrate SUB1 and the front substrate SUB2. Here, with respect to these types of prior art, for example, the following patent document 1 and patent document 2 can be exemplified.

[Patent Document 1]
JP-A-10-134701

[Patent Document 2]
JP-A-2000-306508

In the FED having such a constitution, the control electrode G1 which has electron passing holes EHL is provided between the cathodes K which are formed on the cathode line CL on the back substrate SUB1 and the anode ADE which is formed on the front substrate SUB2, wherein by imparting the given potential difference to the control electrode G1 with respect to the cathode line CL, electrons E are pulled out from the cathodes K and the electrons E are made to pass through the electron passing holes EHL of the control electrode G1 and are made to impinge on the phosphors PHS at the anode ADE side, there by performing an image display.

SUMMARY OF THE INVENTION

However, the FED having such a constitution is configured to define a space having a size of approximately several mm between opposing surfaces of the anode ADE and the cathode line CL and, to make the phosphors PHS efficiently emit light, a high voltage of approximately 5 kV to 30 kV is applied to the anode ADE, a voltage of approximately 1 kV or less is applied to the control electrode G1, and a voltage of several hundreds V is applied to the cathodes K. Due to such a constitution, in the FED, the anode voltage is relatively high compared to other various electrode voltages and hence, there has always existed a possibility that an abnormal discharge is generated between the anode ADE and other electrode with some probability.

Further, in the FED having the electrode structure shown in FIG. 6, when the abnormal discharge occurs either between the anode ADE and the control electrode G1 or between the anode ADE and the cathodes K, the potentials of the control electrode G1 or the cathodes K are elevated to a level substantially equal to the potential of the anode ADE. As a result, the anode potential is applied to respective drive circuits of the control electrode G1 or the cathodes K. Irrespective of the fact that rated voltages of the respective drive circuits of the control electrode G1 and the cathodes K is approximately several hundreds V at a maximum, unless the dielectric strength characteristics take the safety factor into consideration with respect to the anode voltage, the respective drive circuits are broken when the abnormal discharge is generated.

To solve such a drawback, it is necessary to take a countermeasure against surging by using a spark gap or an element such as a Zener diode. However, In the FED, the control electrode G1 and the cathode K are usually subjected to matrix driving and hence, it is necessary to apply countermeasures to prevent the abnormal discharge for every-row line and every-column line in each drive circuit. Accordingly, it is necessary to provide elements of each drive circuit in number which corresponds to the number of lines and hence, a cost of parts is increased and this becomes a main factor for pushing up a manufacturing cost.

Further, with respect to a drive circuit which sufficiently increases the dielectric strength characteristics, since the dielectric strength characteristic becomes abnormally high compared with a rated voltage and hence, a cost of a drive circuit element per se becomes substantially equal to a cost of a drive circuit element for a high drive voltage use whereby there is a possibility that the manufacturing cost is increased along with the increase of cost of the parts. Here, conventionally, there have been known no countermeasures which have taken the prevention of the occurrence of the abnormal discharge into consideration from this point of view.

Accordingly, the present invention has been made to solve the above-mentioned conventional drawbacks and it is an object of the present invention to provide an image display device which detects a dark current when an abnormal discharge occurs between an anode and respective electrodes and controls an anode voltage thus suppressing the dielectric strength of each drive circuit at a low value thus lowering a cost of drive circuit elements. Further, it is another object of the present invention to provide an image display device which can enhance the quality and the reliability by preventing the occurrence of the abnormal discharge.

To achieve the above-mentioned objects, in the image display device of the present invention, by providing dark current detection means, it is possible to detect a dark current when an abnormal discharge occurs and to control an anode voltage by comparing a detected current value and a preset current value.

In the above-mentioned constitution of the present invention, it is desirable that the dark current detection means is constituted by connecting a dark current detection electrode, an ammeter and a DC bias power source in series, wherein the dark current detection electrode is provided outside a screen display region and at a peripheral position adjacent to the anode. It is further preferable that the dark current detection electrode is provided outside a screen display region and at a position where the dark current detection electrode faces the anode, whereby the dark current detection means detects a dark current when the current flows from the anode at the time of occurrence of an abnormal discharge.

Here, it is needless to say that the present invention is not limited to the above-mentioned constitution and the constitutions of respective embodiments described later and various modifications can be made without departing from the technical concept of the present invention.

As explained heretofore, according to the image display device of the present invention, by suppressing the occurrence of the abnormal discharge which occurs between an anode and respective electrodes, it is possible to eliminate the danger that a high voltage attributed to the abnormal discharge is applied to respective drive circuits and hence, it is possible to lower (suppress) the dielectric property of drive circuits. Accordingly, it is possible to lower or suppress the cost of the drive circuit element. Further, it is not necessary to use drive circuit elements having high dielectric property and hence, a set cost can be reduced and, at the same time, the occurrence of the abnormal discharge can be suppressed in advance whereby it is possible to obtain the excellent advantageous effects including the remarkable enhancement of the quality and the reliability.

DETAILED DESCRIPTION OF THE INVENTION

Preferred embodiments of the present invention are explained in detail in conjunction with drawings which show embodiments.

Figure 1:
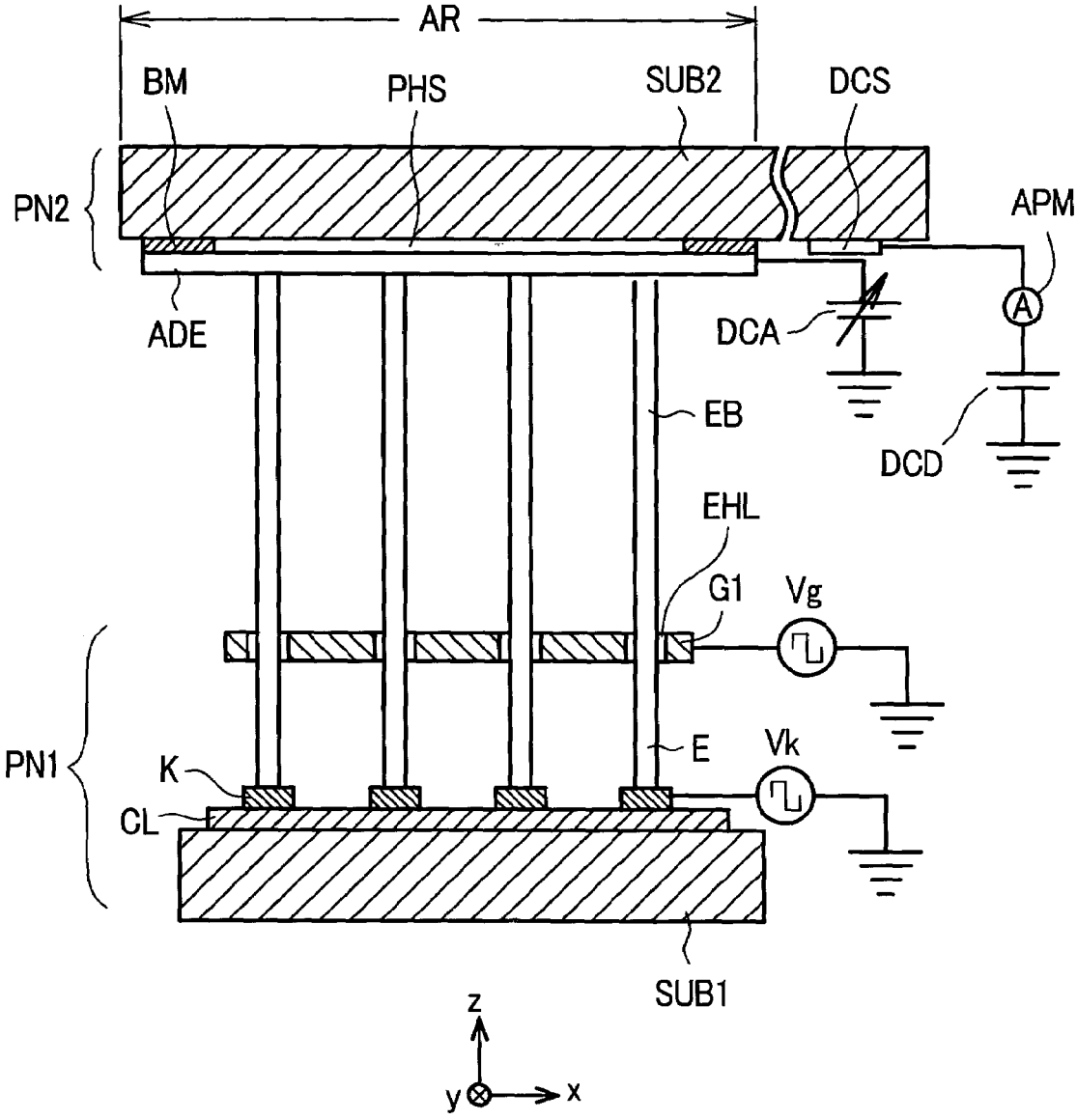
FIG. 1 is a cross-sectional view of the vicinity of one pixel which schematically explains the constitution of one embodiment of an image display device according to the present invention.

FIG. 1 is an enlarged cross-sectional view of the vicinity of one pixel which schematically explains one embodiment of the image display device according to the present invention. In FIG. 1, reference symbol SUB1 indicates a back substrate which is formed of an insulating substrate preferably made of a glass or the like and constitutes a back panel PN1. On an inner surface of the back substrate SUB1, a plurality of cathode lines CL which extend in one direction x (here, the horizontal direction) and are arranged in parallel in another direction y (here, the vertical direction) and have cathodes K as electron sources are formed on an inner surface of the back substrate SUB1.

Further, above the back panel PN1, control electrodes G1 are arranged to face the back panel PN1 in a non-contact state. The control electrodes G1 cross the cathode lines CL in a non-contact state and extend in the y direction, are arranged in parallel in the x direction, and form pixels at portions thereof which cross the cathode lines CL. Further, the control electrodes G1 have a plurality of electron passing apertures EHL in the pixels which allow electrons E emitted from the cathodes K to pass therethrough toward the front panel PN2 side. The cathode lines CL which are formed on the back substrate SUB1 are formed by performing the patterning of a conductive paste containing silver or the like, for example, using printing and, thereafter, by baking.

Further, the cathodes K which are arranged on upper surfaces (front substrate SUB2 side) of portions of these cathode lines CL which intersect the control electrodes G1 are, for example, made of CNT (carbon nanotubes). As an example, the cathodes K are formed by patterning an Ag-B-CNT paste by printing or the like and, thereafter, by baking the patterned paste. Further, the control electrodes G1 are formed such that a large number of electron passing holes EHL having a circular shape are formed in thin plates made of a conductive metal plate material made of nickel, for example, by etching using a photolithography method.

On the other hand, the front panel PN2 is laminated to the back panel PN1 with a given distance therebetween in the z direction using a frame body not shown in the drawing. With respect to the front panel PN2, on an inner surface of a front substrate SUB2 which is formed of a light transmitting insulation substrate such as a glass plate, phosphors PHS which are partitioned by a black matrix BM and an anode ADE are formed.

Further, on an inner surface of the front substrate SUB2, a dark current detection electrode DCS which constitutes a portion of dark current detection means is formed in a state that the dark current detection electrode DCS is formed at a position adjacent to the outside of a screen display region AR of the anode ADE and on a plane substantially equal to a surface on which the anode ADE is formed. The dark current detection electrode DCS is formed by patterning simultaneously with the formation of the anode ADE by applying a transparent high conductive material such as ITO, for example, by a vapor deposition method.

Figure 2:
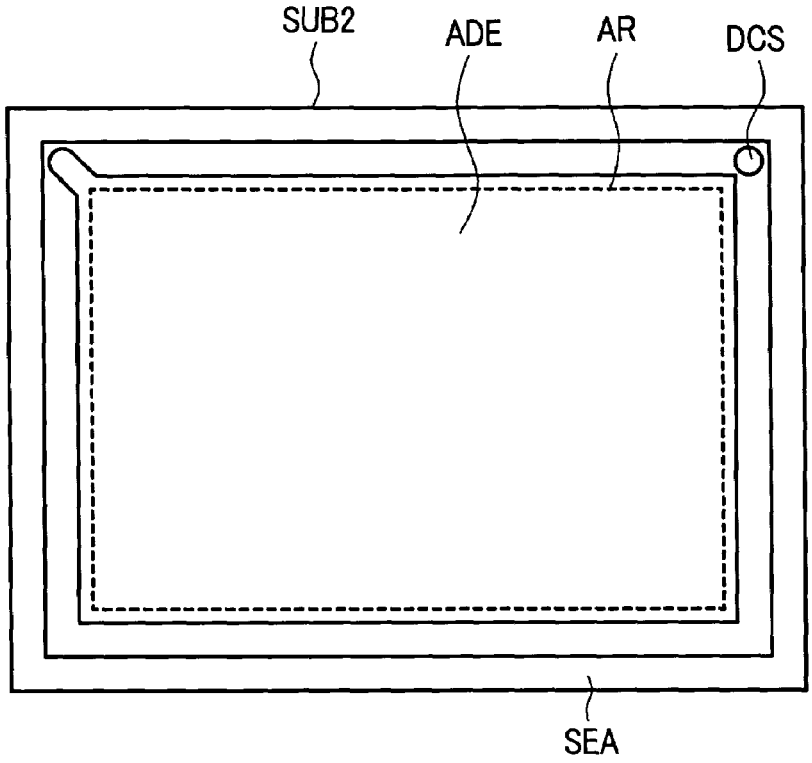
FIG. 2 is a plan view of a face substrate of the image display device shown in FIG. 1 as viewed from the inside thereof.

FIG. 2 is a plan view of the front substrate SUB2 on which the above-mentioned anode ADE, the dark current detection electrode DCS and the like are formed as viewed from an inner surface side. The dark current detection electrode DCS formed on the inner surface of the front substrate SUB2 in FIG. 2 is formed as specifically shown in FIG. 3 which is an enlarged cross-sectional view of an essential part. That is, a detection electrode terminal DCT is formed on a front surface side (outer surface) of the front substrate SUB2 at a position corresponding to the dark current detection electrode DCS and the dark current detection electrode DCS is connected with the detection electrode terminal DCT via a through hole formed in the front substrate SUB2 thus establishing the electric connection between the dark current detection electrode DCS and the detection electrode terminal DCT. Here, in FIG. 2 and FIG. 3, symbol ADT indicates an anode electrode terminal which supplies a DC voltage to the anode ADE and symbol SEA indicates a seal region where the sealing frame body is adhered and arranged.

The dark current detection electrode terminal DCT and the anode electrode terminal ADT adopt the structure in which through holes are formed in the front substrate SUB2 by an etching method using a photolithography method, a conductive paste containing silver or the like is filled into the through holes by patterning a conductive paste using printing and, thereafter, is baked thus forming the detection electrode terminal DCT and the anode electrode terminal ADT, while the dark current detection electrode DCS and the anode ADE which are respectively formed on the inner surface side are electrically connected with each other. Here, the dark current detection electrode terminal DCT can be formed using the same step for forming the anode electrode terminal ADT which is connected with the anode ADE.

Further, a given distance is held between the back panel PN1 and the front panel PN2 by a sealing frame body not shown in the drawing in a state that the sealing frame body surrounds a screen display region AR. The inside of the structure is evacuated to create a vacuum therein and a vacuum state is sealed.

In the FED having such a constitution, a high voltage of 5 to 30 kV is applied to the anode ADE and a DC power source DCA which can change a voltage value is connected to the anode ADE. To the dark current detection electrode DCS, an ammeter APM which detects the flow of a dark current and a DC power source DCD which has a preset voltage value which is more or less lower than the high voltage supplied to the anode ADE are connected in series between grounds. Further, pulse voltages Vk, Vg of approximately 100V which perform the matrix driving are supplied to the cathodes K and control electrodes G1 from respective drive circuits in conformity with respective drive timing.

In such a constitution, when the dark current value detected by the ammeter APM connected to the dark current detection electrode DCS is equal to or below the preset value which is preliminarily set, the anode voltage of the DC power source DCA which is supplied to the electrode terminal ADT of the anode AD is held in an initial set value state. Then, when an abnormal discharge occurs between the anode ADE and the control electrodes G1 or between the anode ADE and the cathodes K due to the degradation of the degree of vacuum or the like and the ammeter APM detects the increase of the dark current value, the voltage value of the DC power source DCA supplied to the anode ADE is changed to assume a smaller value such that the dark current value assumes a value equal to or less than the set value.

Due to such a constitution, by performing the correction on the anode potential supplied to the anode ADE such that the dark current value assumes a value equal to or less than the set value, it is possible to suppress the occurrence of the abnormal discharge in advance. As a result, it is possible to prevent the rupture of the respective drive circuits attributed to the occurrence of the abnormal discharge.

Figure 4:
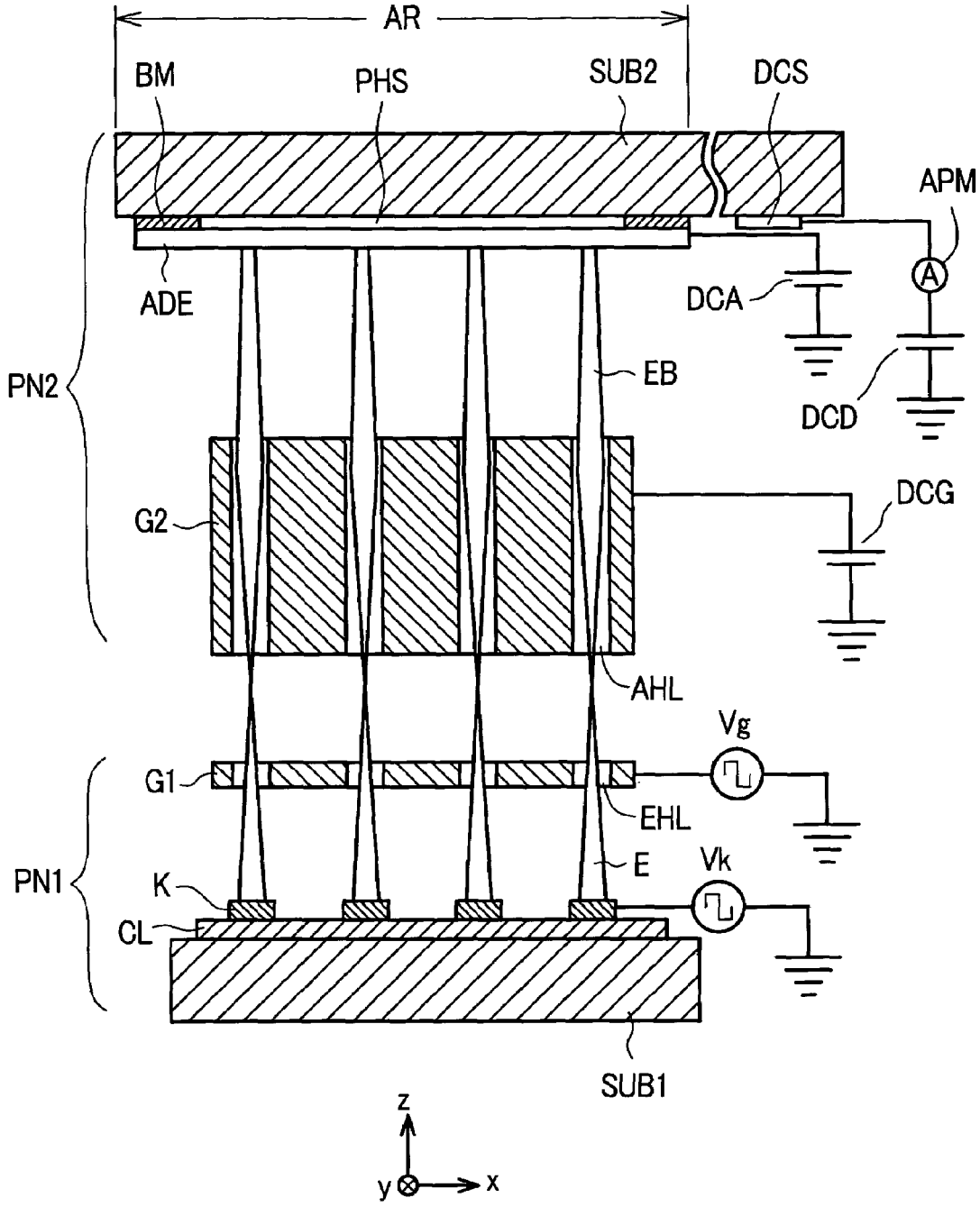
FIG. 4 is a cross-sectional view of the vicinity of one pixel which schematically explains the constitution of another embodiment of an image display device according to the present invention.

FIG. 4 is an enlarged cross-sectional view of the vicinity of one pixel which schematically explains the constitution of another embodiment of an image display device according to the present invention. Parts which are identical with the parts shown in the previously explained FIG. 1 are given same symbols and their explanation is omitted. In FIG. 4, the constitution which makes this embodiment different from the embodiment shown in FIG. 1 lies in that above the control electrodes G1, a focusing electrode G2 having electron beam passing apertures AHL which allow respective electron beams EB to pass therethrough at regions thereof which face the respective electron passing holes EHL formed in the control electrodes G1 is arranged in a non-contact state while facing the anode ADE.

The focusing electrode G2 has the structure in which a large number of electron beam passing apertures AHL having a circular shape are formed in a thin metal plate formed of a conductive metal plate material such as nickel, for example, by an etching method using a photolithography method, and the focusing electrode G2 is fixedly mounted on a front surface side of the back substrate SUB1 using support members not shown in the drawing. To this focusing electrode G2, a DC bias power source DCG of approximately 1 kV which can focus the electrons E which have passed the electron passing holes EHL of the control electrodes G1 toward the anode ADE is connected, the potential of the focusing electrode G2 is set to a potential which makes the focusing electrode G2 function as a focusing electrode with respect to the cathodes K and the control electrodes G1, and the emission of electrons from the cathodes K may be performed in accordance with the triode operation.

In the FED having such a constitution, even when an abnormal discharge is generated between the anode ADE and the focusing electrode G2 and the ammeter APM detects the increase of the dark current value, by performing the correction for the anode potential supplied to the anode ADE to change and lower the voltage value of the DC power source DCA supplied to the anode ADE such that the dark current value becomes equal to or less than the set value, it is possible to suppress the occurrence of the abnormal discharge in advance. As a result, it is possible to prevent the rupture of the respective drive circuits attributed to the occurrence of the abnormal discharge.

Further, as one of reasons that the possibility of occurrence of the abnormal discharge is large, the degradation of the degree of vacuum is exemplified. When the degree of vacuum is degraded, the dark current which flows between the anode and the control electrode or between the anode and the cathode is increased. Accordingly, by providing the dark current detection means which is constituted of the dark current detection electrode DCS, the ammeter APM and the DC bias power source DCD, it is possible to monitor the degradation state of the degree of vacuum by confirming the degree of detection of the dark current value by the ammeter APM.

Figure 3:
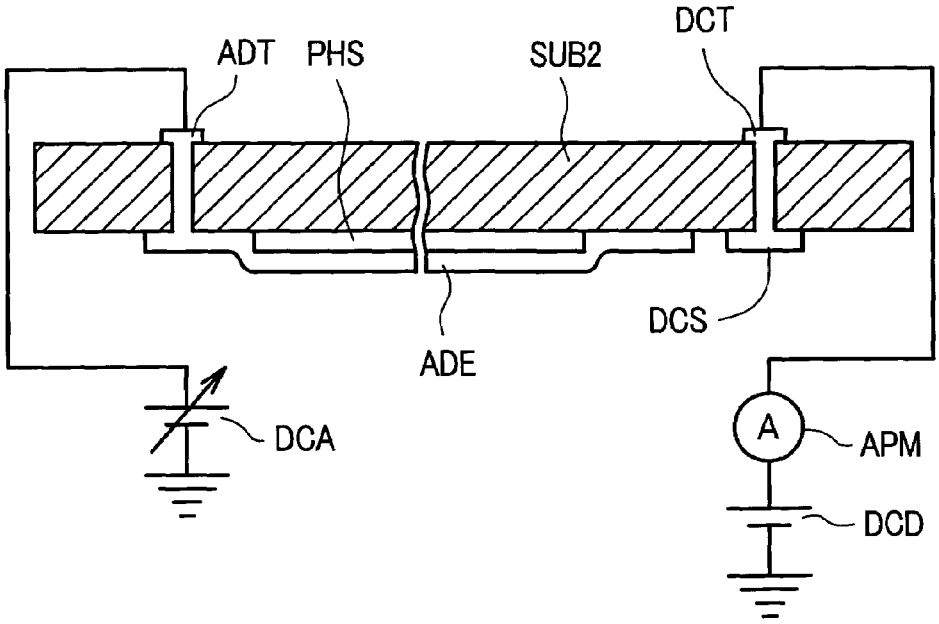
FIG. 3 is an enlarged cross-sectional view of an essential part showing the detailed constitution of dark current detection means shown in FIG. 1.
Figure 5:
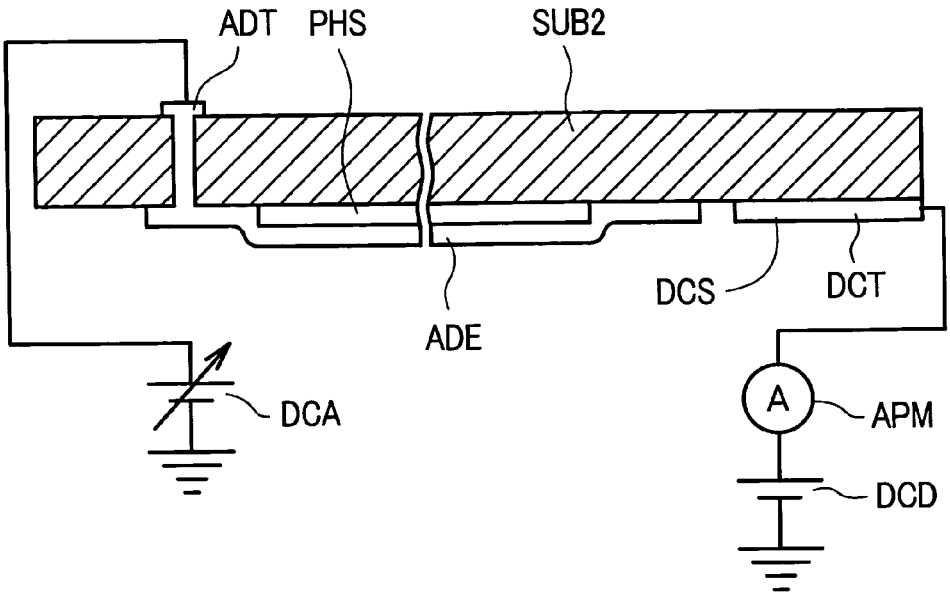
FIG. 5 is an enlarged cross-sectional view of an essential part showing the detailed constitution of dark current detection means according to still another embodiment of an image display device according to the present invention.
Figure 6:
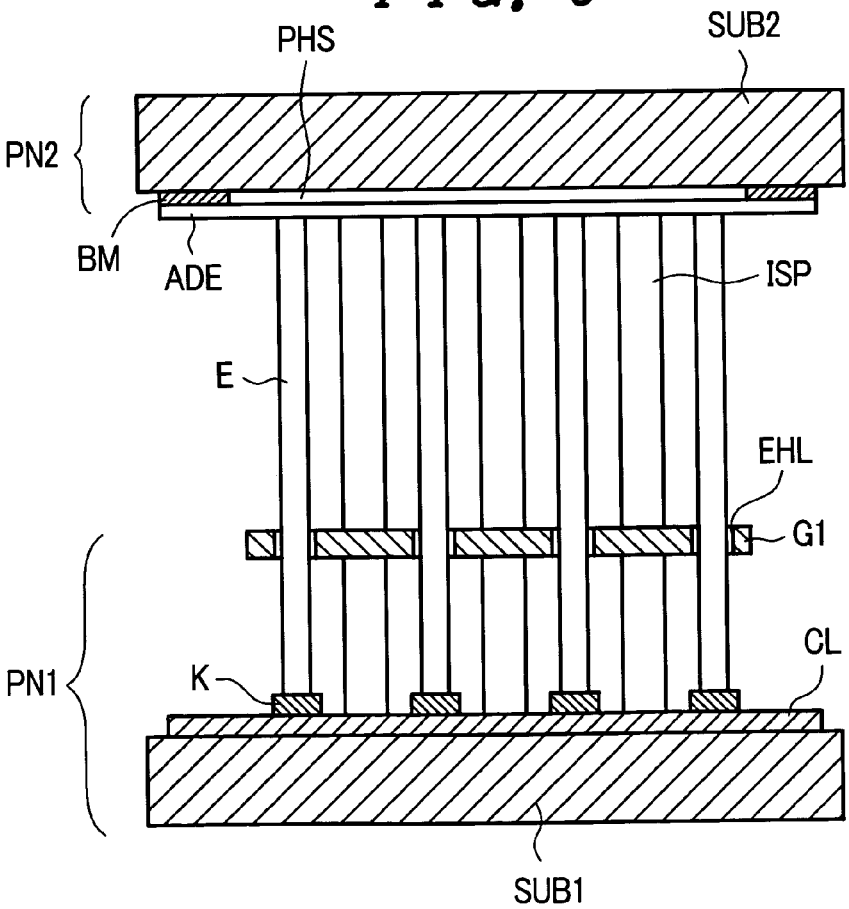
FIG. 6 is an enlarged cross-sectional view of the vicinity of one pixel which schematically shows the basic structure of an image display device.

FIG. 5 is an enlarged cross-sectional view of an essential part for explaining the detailed constitution of dark current detection means according to another embodiment of an image display device of the present invention. Parts which are identical with the parts shown in the previously explained FIG. 3 are given same symbols and their explanation is omitted. In FIG. 5, the constitution which makes this embodiment different from the embodiment shown in FIG. 3 lies in that the dark current detection electrode DCS which is formed on the inner surface side of the front substrate SUB2 is pulled out along the inner surface of the front substrate SUB2 and the dark current detection electrode terminal DCT is formed on an inner-side end surface of the front substrate SUB2. In the constitution shown in FIG. 5, the pull-out portion of the dark current detection electrode DCS is arranged to pass the front substrate SUB2 and the sealing frame body not shown in the drawing.

Here, although, in the above-mentioned respective embodiments, the explanation has been made with respect to the case in which carbon nanotubes are adopted as the electron sources of the image display device, it is needless to say that the present invention is not limited to such an application and even when the present invention is applied to a display or a television receiver set using electron sources of other method, the exactly same advantageous effects as mentioned above can be obtained.

What is claimed is:

1. An image display device comprising:

a face substrate having an anode and phosphors on an inner surface thereof;

a back substrate having a plurality of cathode lines which extend in one direction and are arranged in parallel in another direction which crosses one direction and having electron sources, and control electrodes being arranged to face the cathode lines in a non-contact manner, the control electrodes forming a plurality of electron passing holes which allow electrons emitted from the electron sources to pass therethrough toward an inner surface side of the front substrate in regions thereof which respectively face the electron sources on an inner surface thereof, the back substrate being arranged to face the front substrate in an opposed manner with a given distance therebetween;

dark current detection means having a dark current detection electrode in the vicinity of the anode; and a sealing frame body which is inserted between the front substrate and the back substrate in a state that the sealing frame body surrounds a screen display region and holds the given distance.

2. An image display device according to claim 1, wherein the image display device includes a focusing electrode which is arranged between the front substrate and the back substrate and has apertures which allow the electron beams to pass therethrough in regions which correspond to the electron passing holes.

3. An image display device according to claim 1, wherein the dark current detection means includes the dark current detection electrode outside a screen display region of the anode, and an ammeter and a DC bias power source are connected in series between the dark current detection electrode and a ground surface.

4. An image display device comprising:

a front substrate having an anode and phosphors on an inner surface thereof;

a back substrate having cathodes which constitute electron sources on an inner surface thereof, the back substrate being arranged to face the front substrate in an opposed manner with a given distance therebetween, the electron sources emitting electrons by applying a voltage to the anode of the front substrate;

a sealing frame body which is inserted between the front substrate and the back substrate in a state that the sealing frame body surrounds a screen display region and holds the given distance; and a dark current detection electrode which is formed on an inner surface of the front substrate and outside the screen display region.

5. An image display device according to claim 4, wherein the dark current detection electrode is formed on a plane which is substantially equal to a surface on which the anode is formed.

6. An image display device comprising:

a front substrate having an anode and phosphors on an inner surface thereof;

a back substrate having cathodes which constitute electron sources on an inner surface thereof, the back substrate being arranged to face the front substrate in an opposed manner with a given distance therebetween;

a sealing frame body which is inserted between the front substrate and the back substrate in a state that the sealing frame body surrounds a screen display region and holds the given distance; and a dark current detection electrode which is formed on an inner surface of the front substrate and outside the screen display region, wherein the dark current detection electrode is connected with an ammeter through a DC bias power source.

7. An image display device according to claim 6, wherein the ammeter and the DC bias power source are connected in series between the dark current detection electrode and a ground.

8. An image display device according to claim 7, a voltage value which is preset at the DC bias power source is lower than a voltage supplied to the anode.

9. An image display device according to claim 4, wherein a terminal is formed on the dark current detection electrode.

10. An image display device according to claim 9, wherein the terminal is formed on an outer surface of the front substrate.

* * * * *